US005428370A

United States Patent [19]

Knapp et al.

[11] Patent Number: 5,428,370

[45] Date of Patent: Jun. 27, 1995

[54] MATRIX DISPLAY DEVICE AND ITS METHOD OF OPERATION

[75] Inventors: Alan G. Knapp; Martin J. Edwards, both of Crawley; Roger Pook, East Grinstead, all of England

[73] Assignee: U.S. Philips Corporation, New York, N.Y.

[21] Appl. No.: 316,055

[22] Filed: Sep. 30, 1994

Related U.S. Application Data

[63] Continuation of Ser. No. 175,696, Jan. 3, 1994, abandoned, which is a continuation of Ser. No. 916,442, Jul. 17, 1992, abandoned.

[30] Foreign Application Priority Data

Jul. 17, 1991 [GB] United Kingdom ..... 9115401

[51] Int. Cl.[6] ..... G09G 3/00

[52] U.S. Cl. ..... 345/205; 345/212; 359/86

[58] Field of Search ..... 345/212, 90, 100, 205; 359/84, 88, 86, 85, 56, 55

[56] References Cited

U.S. PATENT DOCUMENTS 4,298,866 11/1981 Hodemaekers ..... 340/784
4,460,247 7/1984 Hilsum et al. ..... 359/86
5,014,048 5/1991 Knapp ..... 340/784

FOREIGN PATENT DOCUMENTS 0185995 12/1985 European Pat. Off. .
0299546 6/1988 European Pat. Off. .
0362939 9/1989 European Pat. Off. .
0425210 10/1990 European Pat. Off. .
2533730 9/1983 France .
2134300 12/1983 United Kingdom .
2129182 5/1984 United Kingdom .
2147135 5/1985 United Kingdom .

*Primary Examiner*—Ulysses Weldon
*Attorney, Agent, or Firm*—Robert J. Kraus

[57] ABSTRACT

A matrix display device comprises a row and column array of picture elements (12) each of which consists of a display element (14), e.g. a LC display element, connected in series with a two-terminal non-linear device 15, such as a MIM, between associated row and column address conductors (16,17) to which selection and data signals are applied by a scanning signal drive circuit (20) and a data signal drive circuit (22) respectively, and a reference element circuit (34), comprising a non-linear device (35) in series with a capacitor (36), forming part of a feedback arrangement through which picture element drive voltages are controlled (25) so as to compensate for the effects of aging of the non-linear devices. The reference circuit is driven like the picture elements, with a scanning signal waveform and voltage signal ($V_A$) applied to opposite sides, and the picture element drive voltages are adjusted in accordance with predetermined changes in the voltage across the capacitor (36). The reference non-linear device (35) can be provided on the same support (10) as the picture element devices (15). The capacitor (36) can be constituted by an electro-optic element corresponding to the display elements (14). A plurality of such reference circuits may be employed, extending in one or more rows and driven by row and column conductors.

23 Claims, 7 Drawing Sheets

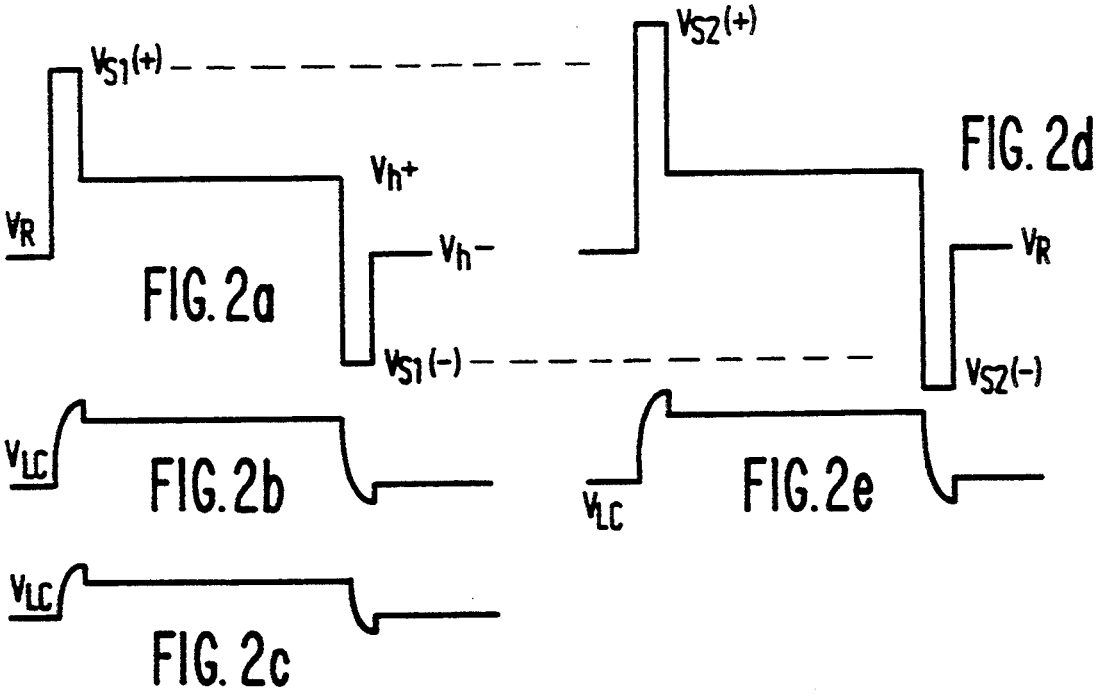
FIG. 2a
FIG. 2b
FIG. 2c
FIG. 2d
FIG. 2e
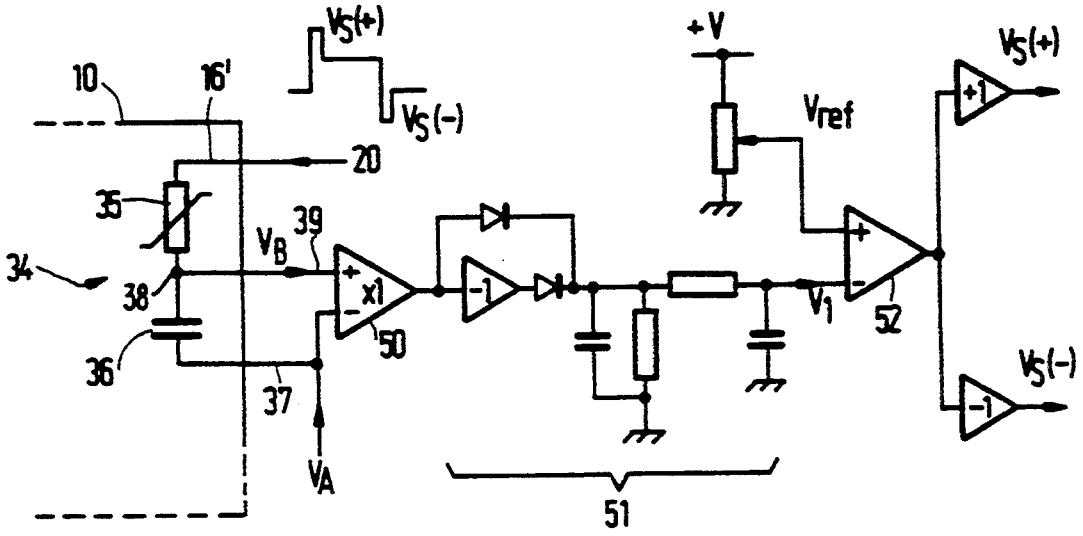
FIG. 3

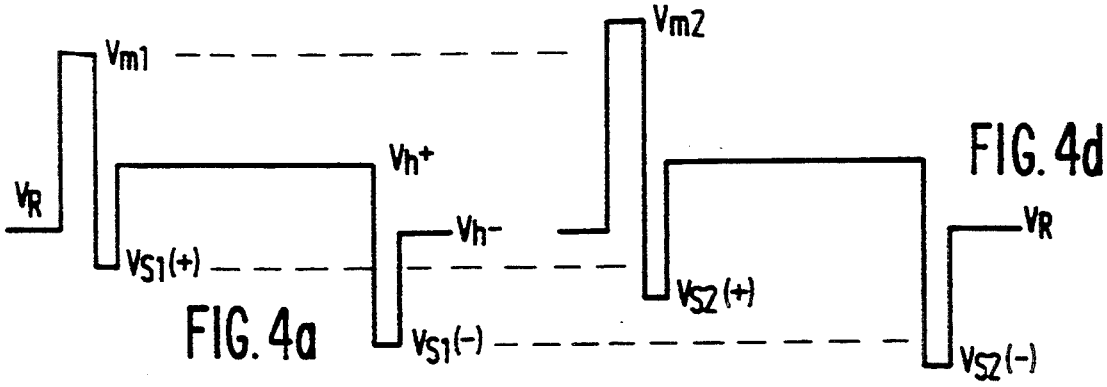
FIG. 4a
FIG. 4d
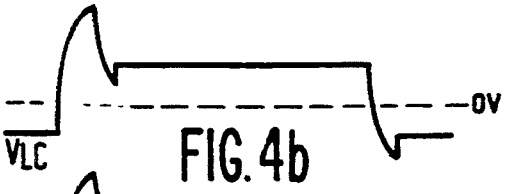
FIG. 4b
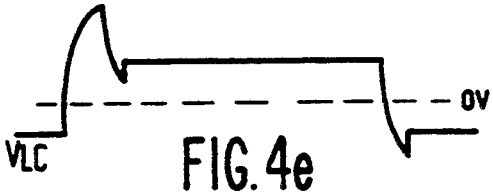
FIG. 4e
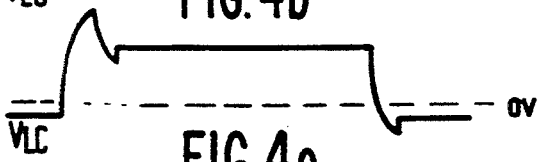
FIG. 4c
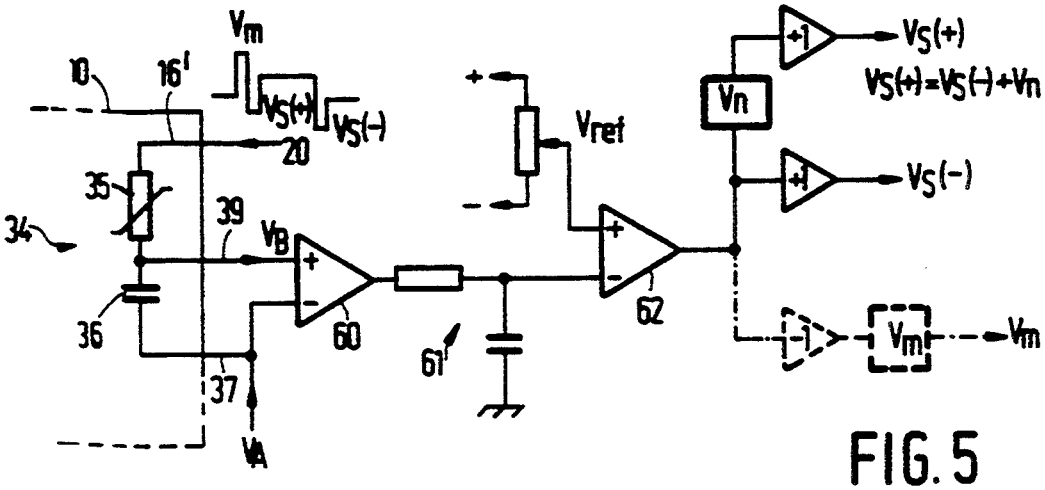
FIG. 5
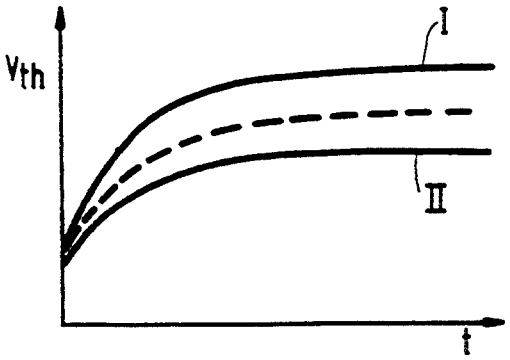
FIG. 6

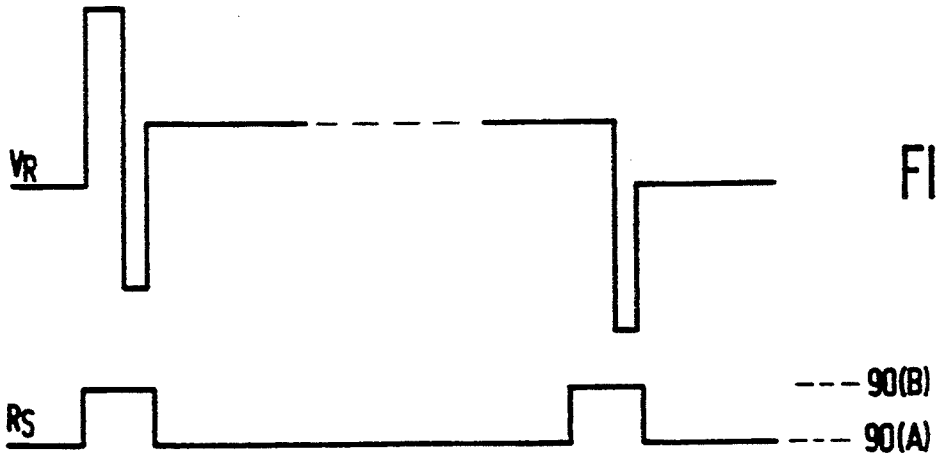
FIG. 10a
FIG. 10b
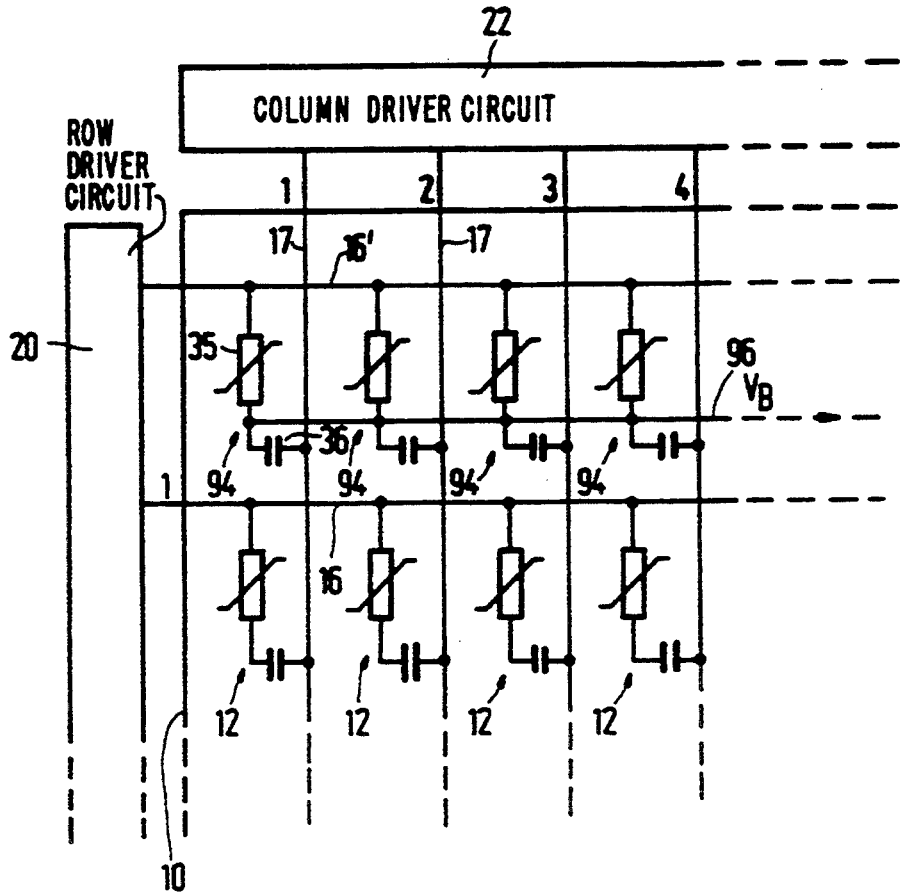
FIG. 11

MATRIX DISPLAY DEVICE AND ITS METHOD OF OPERATION

This is a continuation of prior application Ser. No. 08/175,696, filed on Jan. 3, 1994, now abandoned, which is a continuation of prior application Ser. No. 07/916,442, filed on Jul. 17, 1992 now abandoned.

BACKGROUND OF THE INVENTION

This invention relates to a matrix display device comprising sets of row and column address conductors, a row and column array of picture elements operable to produce a display, each of which comprises an electro-optic display element connected in series with a two terminal non-linear device exhibiting a threshold characteristic between a row conductor and a column conductor, and picture element drive means connected to the sets of address conductors for applying drive voltages to the picture elements comprising a scanning signal drive circuit for applying selection signals to the conductors of one set and a data signal drive circuit for applying data signals to the conductors of the other set. The invention relates also to a method of operating such a display device.

Display devices of this kind are suitable for displaying alpha-numeric or video information using passive electro-optical display media such as liquid crystal material, electrophoretic suspensions or electrochromic materials. Examples of such display devices, using liquid crystal material, are described in GB-A-2129182, EP-A-0185995, and GB-A-2147135. The two terminal non-linear devices can be of various forms, such as diode rings, back to back diodes, MIMs (metal-insulator-metal), etc. which are bidirectional. The polarity of the drive voltages applied to the picture elements can then conveniently be inverted periodically, typically in successive field periods, in order to prevent degradation of the electro-optic display material and improve display quality. The picture elements are addressed by sequentially applying a selection voltage signal to each one of the first set of address conductors, usually the row conductors, and data, for example video, signals to the other set of address conductors to set the display element to a desired display condition which is maintained until they are again selected.

For acceptable quality of display it is important that the non-linear devices of the matrix array demonstrate substantially similar threshold and I–V characteristics in operation so that the same drive voltages applied to any picture element in the array produce substantially identical visual results, for example in the case of a liquid crystal display device, as regards picture element transmission levels. Differences in the threshold or turn-on point of the non-linear devices can appear directly across the electro-optical material producing different display effects from picture elements addressed with the same drive voltages.

Serious problems can arise if the threshold level of the non-linear devices changes over a period of time, for example through ageing effects. The voltage appearing across the electro-optic material depends on the on-current of the non-linear device. If the on-current changes during the life of the display device then the voltage across the electro-optic material also changes. This change may either be in the peak to peak amplitude of the voltage or in the mean d.c. voltage depending on the drive scheme employed. The consequential change in display element voltages not only leads to inferior display quality but can cause an image storage problem and also degradation of the LC material.

In the aforementioned GB-A-2129182 a drive scheme is described which involves a four level row drive in which the scanning signal applied to a row conductor consist of first, selection, voltage level for a selection interval of fixed duration followed by a second, hold, voltage level of less value but of the same polarity as the selection level and which is maintained for at least a major portion of the time which elapses until the row conductor is next addressed with the selection voltage level. The polarity of the selection and hold levels is inverted for successive field periods. It is said that by using this method non-linear devices having a comparatively low threshold voltage would be sufficient, allowing relatively low drive voltages. There is also described briefly in this specification a reference voltage setting circuit which is used to adjust the selection and hold voltages applied to the picture elements in accordance with changes in the threshold voltage level of a non-linear element caused by variations in operating temperatures in use of the display device. This circuit uses a reference non-linear element, namely a diode element, one side of which is connected to ground, and operates to compare the threshold voltage of the reference element with reference potentials comprising a predetermined threshold voltage level. This is achieved by sensing the voltage across the reference element.

SUMMARY OF THE INVENTION

It is an object of the present invention to provide a display device of the kind described in the opening paragraph in which compensation is effected for changes in the characteristics of the non-linear devices reliably and accurately so as to maintain display performance in operation of the display device over a period of time.

According to one aspect of the present invention a matrix display device as described in the opening paragraph is characterised in that the display device includes a reference circuit comprising a capacitor connected in series with a non-linear device of the same kind as those of the picture elements, means for applying to one side of the reference circuit a waveform corresponding to that applied by the scanning signal drive circuit to the conductors of the one set and a voltage signal to the other side of the reference circuit, and control means for adjusting the drive voltages applied by the drive means to the picture elements according to predetermined changes in the voltage across the capacitor of the reference circuit.

According to another aspect of the present invention, there is provided a method of operating a matrix display device comprising sets of row and column address conductors, a row and column array of picture elements operable to produce a display, each of which comprises an electro-optic display element connected in series with a two terminal non-linear device exhibiting a threshold characteristic between a row conductor and a column conductor, in which drive voltages are applied to the picture elements by applying scanning signals comprising selection signals to the conductors of one set and data signals to the conductors of the other set, characterised by the steps of driving a reference circuit comprising a capacitor connected in series with a non-linear device of the same kind as those of those of the picture elements by applying to one side of the reference circuit a waveform corresponding to the scanning signals applied to the conductors of the one set and a voltage signal to the other side of the reference circuit, and controlling the drive voltages applied to the picture elements in accordance with predetermined variations in the voltage across the capacitor of the reference circuit.

The display device thus uses a kind of feedback arrangement through which compensation can be made for changes over time in the on-current of the non-linear devices so as to maintain display performance. In operation of the device, the capacitor of the reference circuit is used to provide an indication of changes in the behaviour of the non-linear device of the reference circuit. In particular, the voltage of the capacitor is indicative of the operating characteristics of the non-linear device so that a change over a period of time in the on-current of the non-linear device will be reflected by a corresponding change in the capacitor voltage. This voltage can be used to provide appropriate compensation for such a change in on-current. It has been found that generally the effects of ageing of many non-linear devices, for example SiN MIMs, are dependent to a large extent on the manner in which the non-linear device is operated and the invention stems from recognition of this fact. As regards a typical picture element,changes in the non-linear devices' operating characteristics are determined by the voltage levels at which the picture element is driven. Driving a picture element to a higher value causes a larger current to flow through its non-linear device with the result that the rate of ageing is increased. Unlike the reference voltage setting circuit described in GB-A-2129182, the reference circuit used in the present invention is equivalent to the circuit of a picture element, comprising a non-linear device connected to a capacitive display element, and is driven in substantially the same manner as the picture elements, using a waveform corresponding to the scanning signal waveform applied to the picture elements and a voltage signal simulating the data signals. As the non-linear device of the reference circuit is of the same kind as those of the picture elements then changes in the way in which the non-linear device of the reference circuit behaves can be assumed to reflect accurately behavioural changes in the non-linear devices of the picture elements. By monitoring changes in the characteristics of the non-linear device of the reference circuit, correction can be made so as to compensate for the corresponding changes in the on-current of the picture element non-linear devices due to ageing processes.

The control means may be arranged to adjust the value of the data signals in accordance with the predetermined changes in the capacitor voltage so as to compensate for sensed changes in the behaviour of the non-linear device. Preferably, however, the control means is arranged to determine the level of the selection signals in accordance with said predetermined changes. In addition to being more convenient to implement, the adjustment of the level of the selection signals avoids the possibility of increased leakage currents occurring during the non-selection periods that can degrade aspects of display performance such as contrast which may result if the data signals are adjusted.

The level of the selection signals is preferably controlled by the control means in accordance with the difference between a time-averaged value of the voltage across the capacitor and a reference voltage.

The invention is particularly beneficial for display devices in which the non-linear devices comprise MIMs. The non-linear devices may, however, comprise other forms of bidirectional devices such as diode rings or back to back diodes. The invention may also be used to advantage in display devices in which the non-linear devices comprise unidirectional devices such as pin or Schottky diodes, for example as described in EP-A-0299546 in which each display element is connected in series with a diode between respective row and column conductors.

The scanning signal drive circuit can be of a known kind, for example as described in GB-A-2129182 which comprises a switching circuit having a plurality of stages each connected to a respective address conductor of the one set and to which potentials determining the potential levels of the scanning signals applied to the address conductors are supplied from a voltage control circuit. Adjustment of the selection signals is then effected simply by controlling the relevant potential level produced by the voltage control circuit. In the drive scheme of GB-A-2129182, the scanning signals comprise selection and hold signals whose polarity is inverted in successive frames thereby making a four level drive scheme. The display device of the present invention may be operated using such a drive scheme. Other drive schemes may, however, be employed. For example, a drive scheme of the kind described in EP-A-0362939 involving a five level scanning signal for picture elements having bi-directional non-linear devices which comprises reset signals in addition to selection signals may be used. Another five level row scanning signal, comprising reset and selection signals having a similar sequence but in which the respective levels differ slightly, is described in aforementioned EP-A-0299546 in relation to the drive scheme for a display device comprising unidirectional non-linear devices connected in series with the display elements between respective row and column address conductors.

In addition to determining the level of the selection signal, the control means may adjust, by way of the voltage control circuit, other voltage levels present in the scanning signals in similar manner, for example the level of the reset signal component in the five level drive scheme.

In the case of a four level row drive, the adjustment to the level of the selection signal component of the scanning signal, is preferably determined so as to maintain the amplitude of the display element voltage at a substantially constant level for a given data signal voltage despite any change which may occur to the threshold voltage level of the non-linear devices. In the case of a five level row drive, the adjustment to the level of the selection signal, or the selection and reset signals, is preferably determined so as to maintain the mean dc voltage of the display element at a substantially constant level for a given data signal voltage.

In order that the non-linear device of the reference circuit exhibits ageing effects, and ages at the same rate, as those of the picture elements, the device of the reference circuit preferably is fabricated using the same technology and materials as those of the picture elements, although it may have different physical dimensions. The non-linear device of the reference circuit may be provided separately from the non-linear devices of the picture elements, that is, fabricated on a different support. For convenience and simplicity, however, the reference circuit non-linear device is preferably provided on the same support as the picture element non-linear devices, and fabricated simultaneously therewith. In this case, the capacitor of the reference circuit may be provided as a capacitor structure on the support, as a component separate from the support, or provided as an electro-optic element in the manner of the display elements, that is comprising an electrode carried on the support, a counter electrode carried on an opposing support and with electro-optical material therebetween.

When provided on the same support as the picture element non-linear devices, the non-linear device of the reference circuit may then conveniently be connected to an address conductor of the set also provided on that support. This set may be the set connected to the scanning signal drive circuit, in which case the address conductor connected to the reference circuit is one which is not associated with the array of picture elements. In this way, with the scanning signal drive circuit addressing each conductor of the one set in turn, the appropriate corresponding waveform is applied in turn to the reference circuit.

The voltage signal applied to the other side of the reference circuit, in effect simulating the data (video) signals applied to the picture elements, may correspond in level approximately with the data signal levels applied to the picture elements, for example an average data signal level. The voltage signal may be of a fixed, preset, magnitude, for example corresponding to a predetermined average data signal level. Assuming the picture element drive signals are inverted after every field, and, in some cases every line, as is usual in LC display devices, the polarity of the voltage signal is similarly inverted every field, and in the appropriate cases every line. Alternatively, the level of the voltage signal may be derived on the basis of the levels of data signals applied to picture elements over a predetermined period, for example by using of a low pass filter. In this case a non-linear circuit may be used in the path of the voltage signal to the reference circuit by means of which any dependence of non-linear device ageing on data signal level is taken into account so that the ageing rate of the reference circuit non-linear device is closely matched to that of an average picture element.

In the case where the capacitor of the reference circuit is constituted by an electro-optic element, the voltage signal may conveniently be supplied to the reference circuit via an address conductor of the other set. To this end, the signal applied to this conductor of the other set is periodically switched between that intended for the picture elements and the voltage signal.

The display device may include a plurality of reference circuits. This can readily be achieved by providing a plurality of additional non-linear devices on the same support as the picture element non-linear devices. For example, the reference circuits can be provided in the manner of an additional row, or part row, of picture elements but separate from, that is, outside the array of the picture elements producing the display. These additional elements can be driven with a scanning signal waveform via a conductor of the one set common to the reference circuits. In this way, the electrical behaviour of the non-linear devices of the reference circuits is more likely to be as close as possible to that of the picture element non-linear devices. The picture element drive voltages can then be adjusted according to the average of the voltages of the capacitors of the reference circuits.

In a preferred embodiment, a plurality of sets of reference circuits are provided with at least one set being arranged adjacent to one side of the area occupied by the array of picture elements and at least one other set being arranged adjacent to the opposing side of said area. The opposing sets of reference circuits can be used to ensure that the average behaviour of the non-linear devices of the reference circuits substantially matches the average behaviour of the non-linear devices over the whole display area. Moreover, a degree of redundancy is provided in that feedback compensation can be used even if only one set of reference circuits is functioning correctly.

BRIEF DESCRIPTION OF THE DRAWING

A matrix display device, comprising a liquid crystal display device, and its method of operation, in accordance with the present invention will now be described, by way of example, with reference to the accompanying drawing figures, in which:

FIGS. 2(*a*) to 2(*e*) are schematic waveforms illustrating scanning signals according to a first known drive scheme, the voltage of a typical liquid crystal display element of the device, and the effect thereon of ageing of the element's associated non-linear device;

FIG. 3 shows schematically a part of the drive circuit of the display device including a reference circuit and using the first known drive scheme which is operable as a feedback circuit to compensate for changes in the operating characteristics of non-linear devices of the picture elements;

FIGS. 4(*a*) to 4(*e*) illustrate schematically waveforms in similar manner to FIG. 2 according to a second known drive scheme;

FIG. 5 shows schematically a part of the drive circuit of the display device including a reference circuit and using the second known drive scheme which is operable as a feedback circuit to compensate for changes in the operating characteristics of non-linear devices of the picture elements;

FIG. 6 illustrates graphically the effects of ageing of a typical non-linear device of the picture elements;

FIGS. 10*a* and 10*b* illustrate waveforms present in operation of the display device using the circuit of FIG. 9;

FIG. 11 is a schematic plan view of part of an embodiment of the invention which uses a plurality of reference circuits;

The same reference numerals are used throughout the Figures to indicate the same or similar parts.

DESCRIPTION OF THE PREFERRED EMBODIMENTS

Figure 1:
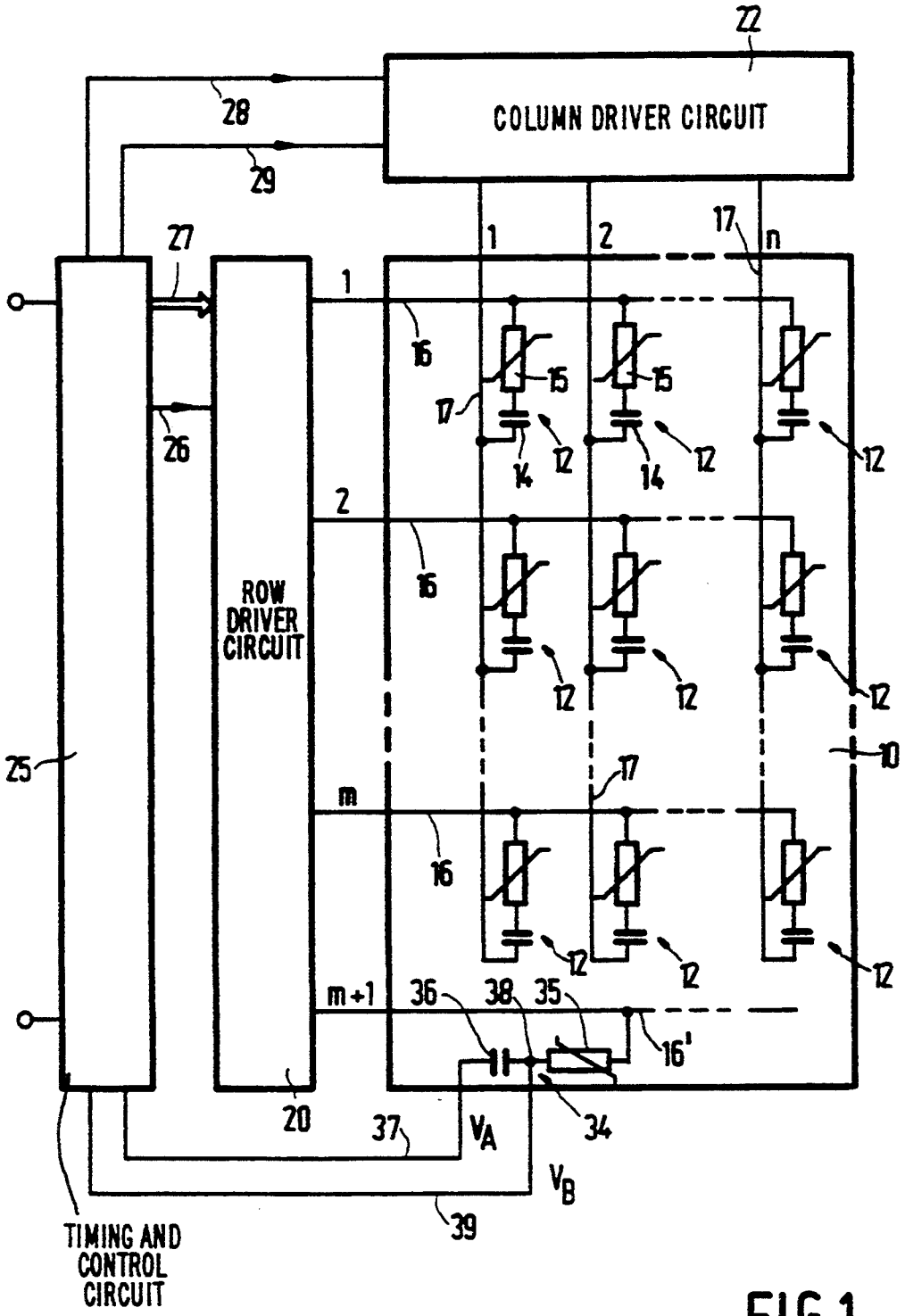
FIG. 1 is a simplified schematic block diagram of an embodiment of display device according to the invention.

Referring to FIG. 1, the display device is intended to display video information, for example TV pictures, and comprises an active matrix addressed liquid crystal display panel 10 consisting of m rows (1 to m) with n picture elements (1 to n) in each row. Each picture element 12 consists of a twisted nematic liquid crystal display element 14 connected electrically in series with a bidirectional non-linear resistance device 15, exhibiting a threshold characteristic and acting as a switching element, between a row conductor 16 and a column conductor 17. The picture elements 12 are addressed via sets of row and column conductors 16 and 17 which are in the form of electrically conductive lines carried on respective opposing faces of two, spaced, glass supporting plates (not shown) also carrying the opposing electrodes of the liquid crystal display elements. The devices 15 are provided on the same plate as the set of row conductors 16.

The row conductors 16 serve as scanning electrodes and are addressed by a row driver circuit 20 which applies a scanning signal, comprising a selection signal component, to each row conductor 16 sequentially in turn. In synchronism with the scanning signals, data signals are applied to the column conductors 17 from a column driver circuit 22 to produce the required display from the rows of picture elements associated with the row conductors 16 as they are scanned. In the case of a video, e.g. TV, display system these data signals comprise video information. The selection signal component determines a row selection period in which the optical transmissivity of the display elements 12 of the row are set to produce the required visible display effect according to the data signals present on the conductors 17 during this period. The individual display effects of the picture elements 12, addressed one row at a time, combine to build up a complete picture in one field, the picture elements being refreshed in a subsequent field. Using the transmission/voltage characteristics of a liquid crystal display element grey scale levels can be achieved. The voltage/conduction characteristic of the two-terminal non-linear devices 15 is bidirectional so that by reversing the polarity of the scanning and data signal voltages in, for example, successive fields a net dc bias across the display elements can be avoided.

Active matrix liquid crystal display devices employing two terminal non-linear resistance devices as switching elements in series with the display elements are generally well known and hence the foregoing description of the main features and general operation of the display device with regard to FIG. 1 has deliberately been kept brief for simplicity. For further information reference is invited to the aforementioned publications describing such types of display devices. The row and column driver circuits 20 and 22 are of conventional form, as described for example in GB-A-2129182, and are controlled by a timing and control circuit, generally referenced at 25, which comprises a video processing unit, a timing signal generation unit and a power supply unit. The row drive circuit 20 comprises a digital shift circuit and switching circuit to which timing signals and voltages determining the scanning signal waveforms are applied from the circuit 25 through supply lines 26 and 27. The column driver circuit 22 comprises one or more shift register/sample and hold circuits and is supplied from the video processing unit with video data signals along line 28 derived from a video (TV) signal containing picture and timing information. Timing signals are supplied to the circuit 22 along the line 29 in synchronism with row scanning to provide serial to parallel conversion appropriate to the row at a time addressing of the panel 10.

Row scanning is accomplished using a waveform comprising either four or five levels, as described for example in aforementioned GB-A-2129182 and EP-A-0362939 respectively to which reference is invited for further information and whose disclosures are incorporated herein by reference.

In this embodiment the non-linear devices 15 comprise MIMs. However other forms of bidirectional non-linear resistance devices exhibiting a threshold characteristic, for example diode rings, back to back diodes, or other diode structures may be used instead.

In known active matrix liquid crystal display devices using two terminal non-linear devices such as diodes or MIMs as the active elements, the voltage appearing across the liquid crystal depends on the on-current of the active device. If the on-current of the non-linear device changes during the life of the display device then there is a consequential change in the voltage appearing across the associated liquid crystal (LC) display element. The nature of this change depends on the drive scheme employed. It may either be in the peak to peak amplitude of the LC display element voltage if a four level row drive scanning signal is used or in the mean dc voltage on the LC element if a five level row drive scanning signal is used. To overcome this problem the display device comprises means for compensating for such changes in the active device characteristics. The display device includes a reference non-linear device of the same kind as those of the picture elements, whose behaviour is monitored and information derived therefrom is used to adjust row drive voltages so as to maintain the voltages across the LC display elements despite changes in the non-linear device characteristics due to ageing. Referring to FIG. 1, the reference non-linear device, comprising a MIM, is indicated at 35 and is connected in series with a capacitor 36 to form a reference element circuit 34. The MIM 35 in this example is fabricated simultaneously with the devices 15, using the same technology and materials, on the same support of the display panel 10. The MIM 35 is thus substantially identical to the MIMs 15 in many respects, although it may have larger physical dimensions so as to ensure that stray capacitance associated with the external circuitry remains small compared to the capacitance of the capacitor 36.

The reference circuit 34 is thus substantially equivalent to the circuit of a typical picture element and can be regarded for convenience as a reference picture element. The MIM 35 is connected to a supplementary, $(m+1)^{th}$, row conductor 16' which is not associated with the picture elements 12 but to which a scanning signal waveform of the same kind as applied to the row conductors 1 to m is supplied by the row driver circuit 20 whereby a selection signal is applied to the row conductor 16' after selection of the $m^{th}$ row.

The other side of reference element circuit 34 is supplied with the equivalent of a column, (data), voltage signal, hereinafter referred to as $V_A$, via a line 37 from the control circuit 25. A further connection is made to the junction 38 Between the capacitor 36 and the MIM 35 via the line 39. The reference element 34 is thus driven in the manner of a picture element, and changes in the operational characteristics of the MIM 35 over a period of time can be regarded as reflecting, and representative of, corresponding changes in the MIMs 15 of the picture elements.

The operation of the display device using a four level row drive scheme will be considered first. The effects of MIM ageing, and appropriate compensation, are illustrated by the schematic waveforms of FIGS. 2(*a*) to 2(*e*). FIG. 2(*a*) illustrates part of a scanning signal waveform, $V_R$, applied to a row conductor according to this scheme. This consists of a selection signal portion of magnitude $V_{S1}(+)$ and of duration corresponding to a row selection period, i.e. line time, which is followed immediately by a hold signal portion of lower voltage, $V_{h+}$, but of like polarity for the remainder of the field period. These signals are inverted in successive fields so that in the next field the row conductor concerned is addressed with a selection signal $V_{S1}(-)$ followed by a hold signal, $V_{h-}$. FIGS. 2(*b*) and 2(*c*) show the voltage, $V_{LC}$, across a display element of the selected row, for a given data signal voltage, initially and after a period of time of conventional operation of the the display device respectively from which it is seen that the display element voltage falls to a lower amplitude as a result of a reduction in the MIMs on-current through ageing. This reduction in the display element voltage produces a different transmission level, and hence brightness. By increasing the magnitude of the selection signals to $V_{S2}(+)$ and $V_{S2}(-)$ respectively as shown in FIG. 2(*d*), then compensation can be achieved so that the amplitude of the display element voltage $V_{LC}$, and hence its transmission level, is restored to its original level, as shown in FIG. 2(*e*). The necessary adjustment to the selection signal level required to correct for changes in the MIM's on-current is accomplished by means of the circuit depicted schematically in FIG. 3. The voltage $V_A$ supplied along the line 37 to one side of the capacitor 36 is fed also to one input of a subtractor circuit 50. The voltage existing at the junction 38, designated $V_B$, is fed via the line 39 to the other input of the circuit 50. The output of the circuit 50 is fed into a rectifier and low pass filter circuit 51 whose output, $V_1$, corresponding to the time average value of the capacitor voltage, is supplied to one input of a comparator 52. The other input of comparator 52 is supplied with a predetermined reference potential, $V_{ref}$. Thus the mean amplitude, $V_1$, of the time averaged voltage across the capacitor 36 ($V_B$-$V_A$) is compared with the reference level $V_{ref}$. The output from comparator 52 representing the difference is used to control the voltage levels provided by the power supply unit to the row driver circuit 20 used for the selection signals $V_S(+)$ and $V_S(-)$. A decrease in the value of $V_1$ therefore causes $V_S(+)$ and $V_S(-)$ to increase until $V_1$ is once again equal to $V_{ref}$. The time constant of the feedback loop constituted by this circuit should be significantly longer than the field period of the display, a typical value being around 1 second. The simple rectifier circuit shown in FIG. 3 may be replaced by a more accurate rms to dc conversion circuit.

In the case of the display device being operated using a five level row drive scheme, the effects of ageing of the MIMs 15, and appropriate compensation, are illustrated by the schematic waveforms of FIGS. 4(*a*) to 4(*e*), corresponding to FIG. 2(*a*) to (*e*) respectively. FIG. 4(*a*) shows a portion of a typical row scanning signal waveform, $V_R$, which in addition to selection and hold signal portions, $V_{S1}(+)$, $V_{S1}(-)$, $V_h(+)$ and $V_h(-)$, consists of a reset signal $V_{m1}$ applied immediately preceding a selection signal $V_{S1}(+)$ so as to discharge the row of display elements prior to their selection. FIGS. 2(*b*) and 2(*c*) show the resulting voltage appearing on a display element, for a given data signal value, initially and after ageing of the MIM of the picture element respectively. It is seen that changes in the properties of the MIM due to ageing causes a shift in the dc level of the display element voltage, which leads to problems with image storage and degradation of the liquid crystal material. The amplitude of the display element voltage and hence, for shifts below approximately 1 volt for typical liquid crystal materials, the transmission of the display element are not changed. By appropriate adjustment to the levels of the selection signal portions, and optionally the reset signal portion, of the row drive waveform, as shown in FIG. 4(*d*), the dc level of the display element voltage can be returned to its original value, i.e. substantially zero, as shown in FIG. 4(*e*) thereby compensating for these effects of MIM ageing.

The necessary adjustment to the reset and selection signal portions for the case of the display device operating with a five level row drive scheme is accomplished by means of the circuit depicted schematically in FIG. 5. The voltages $V_A$ and $V_B$ are supplied to a buffer amplifier 60 whose output is fed, via a low pass filter 61, to one input of a high gain differential amplifier 62 whose other input is supplied with a predetermined reference potential, $V_{ref}$. Thus, the mean dc level of the voltage across the reference capacitor 36, $V_A$-$V_B$, is, after low pass filtering, compared with the reference voltage $V_{ref}$. The output of the amplifier 62 is used to control voltage levels provided by the power supply unit to the row driver circuit 20 for the reset and selection signal portions of the row drive waveform. More particularly, the difference output from the amplifier 62 is used in the feedback loop to change the values of $V_S(+)$ and $V_S(-)$ by equal amounts in the same direction so as to return the mean dc voltage in the reference circuit 34 to its original value, thereby compensating for the effects of MIM ageing. Adjustment of the level of the reset signal portion $V_M$ is optional and the relevant part of the circuit of FIG. 5 may be omitted.

Figure 7A:
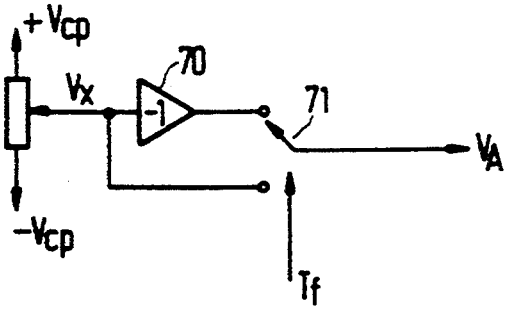
FIGS. 7(*a*) through 7(*c*) show alternative forms of circuits used in the display device for deriving a voltage signal used in the feedback circuits of FIGS. 3 and 5.
Figure 7B:
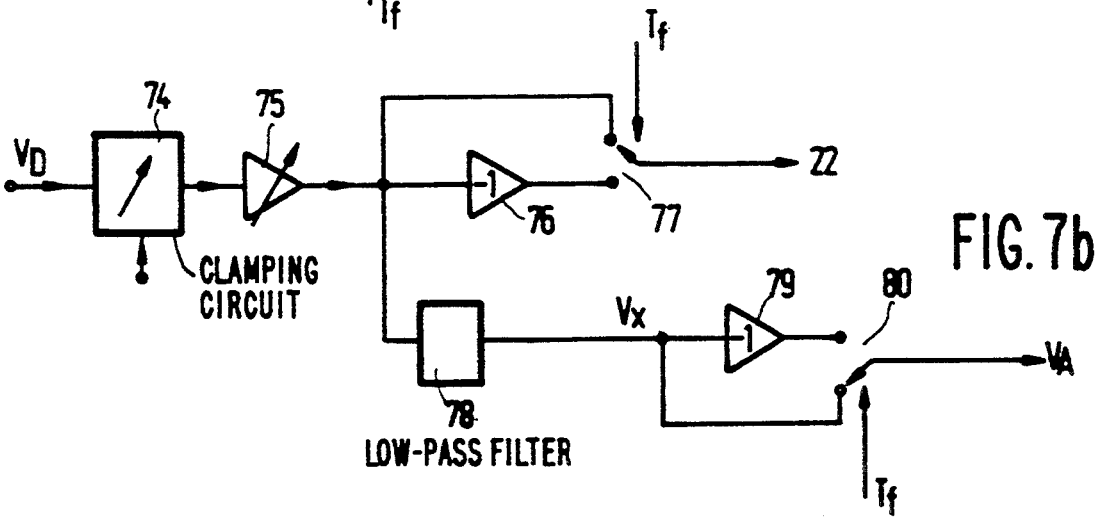

In general, the ageing of the picture element MIMs 15 has been found to vary somewhat with the voltage level applied to the picture elements, i.e. the data (video) drive level. The driving of a display element to a higher value causes larger currents to flow through the associated MIM 15 and increases the rate of ageing. This effect is illustrated graphically in FIG. 6 which shows the variation in the on-voltage (i.e. threshold voltage), Vth, of a MIM 15 over time, t. The solid curves I and II show the effects of ageing of a MIM of a picture element driven fully black and fully white respectively, corresponding to a relatively high and low drive levels respectively, in a twisted nematic LC display device using crossed polarisers. The drive level applied to the MIM 15 of the reference circuit 34 preferably is arranged to be some average of the drive levels of the MIMs 15 of the picture elements so that the ageing of the MIM 35 takes the form approximately of the dashed curve in FIG. 6, which is typical of picture elements driven at a range of levels. The drive level on the reference circuit 34 is determined by the voltage signal $V_A$, representing a video level, during the period in which the reference circuit in effect is selected by the selection signal portions of the applied scanning signal waveform. This drive level may be selected in one of two ways as shown by the schematic circuit diagrams of FIGS. 7*a* and 7*b* respectively. In the simpler circuit of FIG. 7*a*, a preset reference voltage $V_x$ lying between $+V_{cp}$ and $-V_{cp}$ is selected and in accordance with the well-known inverting drive requirements of LC materials, is switched in polarity every field by means of an inverter 70 and a switch 71 operated by a line/field inversion timing signal $T_f$ in similar manner to the data signals applied to the columns 17 by the column driver circuit 22. The preset value $V_x$ is chosen to correspond to some predetermined average data signal level of the picture element MIMs 15.

In the circuit of 7(b), the reference circuit voltage signal level is determined by the existing video signal and thus in accordance with data signals supplied to the picture elements by the column driver circuit 22. The video signal, $V_D$, after adjustment by a black level clamping circuit 74 and a variable gain (contrast) circuit 75 of the video processing unit of the circuit 25, is supplied to an inverting circuit consisting of an inverter 76 and a switch 77 operated by a line/field inversion timing signal $T_f$ before passing to the column driver current 22. The processed video signal is supplied also to a low pass filter 78 from which a reference voltage level, here also designated $V_x$ for simplicity, is obtained and then passed to an inverting circuit comprising an inverter 79 and switch 30, operating in similar manner to the inverting circuit 76 and 77, whose output provides the drive voltage signal $V_A$. Optionally, a non-linear circuit may be included between the low pass filter and the inverting circuit, as shown in dashed outline at 81 in FIG. 7(*b*). By using an appropriate non-linear circuit 81 in the signal path it is possible to account for any known dependence of MIM ageing on average data signal level and hence to match closely the ageing rate of the MIM 35 of the reference circuit 34 to that of an average picture element and optimise the degree of correction obtained in the compensation process.

Figure 8A:
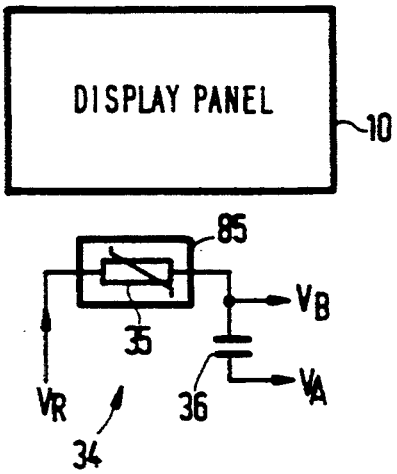
FIGS. 8(*a*) and 8(*b*) illustrate schematically alternative ways in which a reference element may be provided for the display device.
Figure 8B:
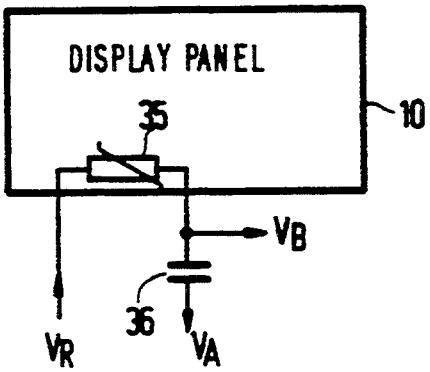

The way in which the drive signal $V_A$ is applied to the reference circuit 34 depends on the manner in which the reference circuit is provided. In the above described embodiment the reference circuit 34 is provided (FIG. 1) on the display panel 10 together with the picture element MIMs 15. The main requirement for the MIM 35 is that it ages at the same rate as the MIMs 15 of the picture element array. Also, the ratio of the capacitance of the capacitor 36 to the size of the MIM 35 and its capacitance should preferably match that found in the picture elements 14. To meet the former requirement, the technology and materials used to fabricate the MIMs 35 and 15 should be the same, as should the current density and waveforms they experience. However, this does not mean that all, or part, of the reference circuit 34 has to be provided on the display panel 10. Various alternatives to the arrangement depicted in FIG. 1 are possible, as are shown in FIGS. 8(*a*), and (*b*). In the arrangement of FIG. 8(*a*), the reference circuit 34 is provided separate to the display panel 10, with the MIM 35 being fabricated on a separate glass support and connected to an appropriate capacitor 36. The capacitor 36 may also be fabricated on this glass support. In the arrangement of FIG. 8(*b*), the MIM 35 of the reference circuit 34 is provided on the display panel 10, thus conveniently enabling its fabrication simultaneously with the MIMs 15, while the associated capacitor is provided separately. With the arrangements of FIG. 8(*a*) and 8(*b*) and FIG. 1 then the voltage signal $V_A$ can be applied directly to the reference circuit using a dedicated line.

Figure 9:
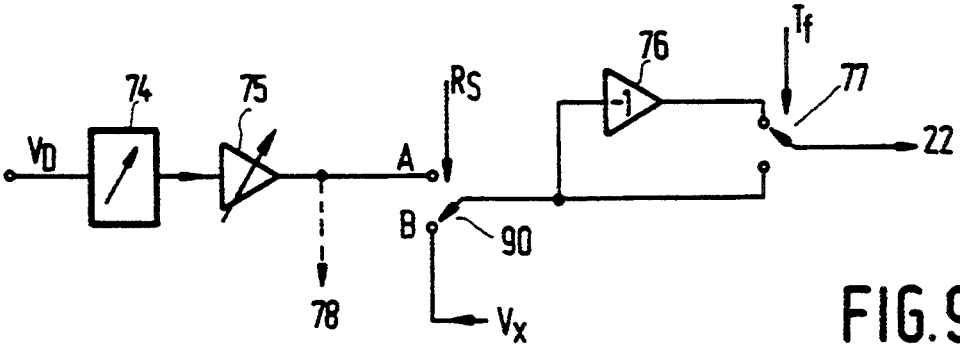
FIG. 9 shows schematically part of one example of drive circuit of the display device used in addressing the reference circuit.

In an arrangement in which both the MIM 35 and the capacitor 36 are provided on the display panel 10, the capacitor may be formed from thin film conductive layers separated by an insulator layer on the same support as the MIMs 15 and 35 and the conductors 16 using common materials. Alternatively, the capacitor 36 may take a form similar to that of the display elements 14, that is, an electro-optic element comprising opposing electrodes on the two, spaced, glass supporting plates of the panel 10 with LC material therebetween. In addition to simplifying the provision of capacitor 36, the reference circuit then more closely resembles a typical picture element and can be expected to exhibit behavioural characteristics substantially identical to that of a typical picture element. In such an arrangement, the supply of the voltage signal $V_A$ to the reference circuit can be accomplished by connecting the electrode of the LC element forming the capacitor 36 on the plate carrying the column conductors 17 to one of those column conductors, in the same manner to that employed for the electrodes of the display elements. In practice, and as is known in such display devices, the column conductors 17 are formed as wide strips and respective portions thereof which overlie display element pad electrodes on the opposing, MIM- carrying, plate constitute the opposing display element electrodes. In like manner, a portion of a columnconductor can be used to constitute one side of the capacitor 36. The signal $V_A$ is switched onto the column conductor concerned only during the period when the reference circuit is selected, as determined by the selection signal portion of its scanning waveform, with the column driver circuit 22 providing data signals on that column conductor in the usual manner for the remaining time. FIG. 9 shows a modified form of part of the circuit of FIG. 7(*b*) by which this can be achieved. A switch, 90, is interposed between the contrast adjustment circuit 75 and the inverting circuit 76 and 77 and is operable periodically (corresponding to the selection of the reference circuit) by a reference level switching signal $R_S$ so as to switch the input to the inverting circuit from the output of the circuit 75 to the reference drive level $V_x$. This reference level is derived using the circuit arrangement of either FIG. 7(*a*) or FIG. 7(*b*) and corresponds to the voltage signal applied to the input of the inverting circuit 70,71 (FIG. 7(*a*)) or the inverting circuit 79,80 (FIG. 7(*b*)). In the case of the circuit of FIG. 7(*b*) being used then the connection to the low pass filter 78 is made, as illustrated in broken outline in FIG. 9, between the circuit 75 and the switch 90. FIGS. 10(*a*) and (10*b*) show waveforms present in operation of the display device using the circuit of FIG. 9 to illustrate the timing of the operation of the switch 90. FIG. 10(*a*) shows part of the waveform of the scanning signal $V_R$ supplied to the reference circuit, comprising in this example a five level scanning signal. FIG. 10(*b*) shows part of the waveform of the reference level switching signal $R_S$ which consists of a series of regular pulses whose timing corresponds to that of the selection signal portions of the $V_R$ waveform. In the case where the column driver circuit 22 is of the known kind which introduces a one line time delay the pulses should occur one line time earlier. For the duration of these pulses, the inverting circuit 76,77 is connected by operation of the switch 90 to the reference drive level $V_x$. At all other times the inverting circuit is connected to the output from circuit 75.

Figure 7C:
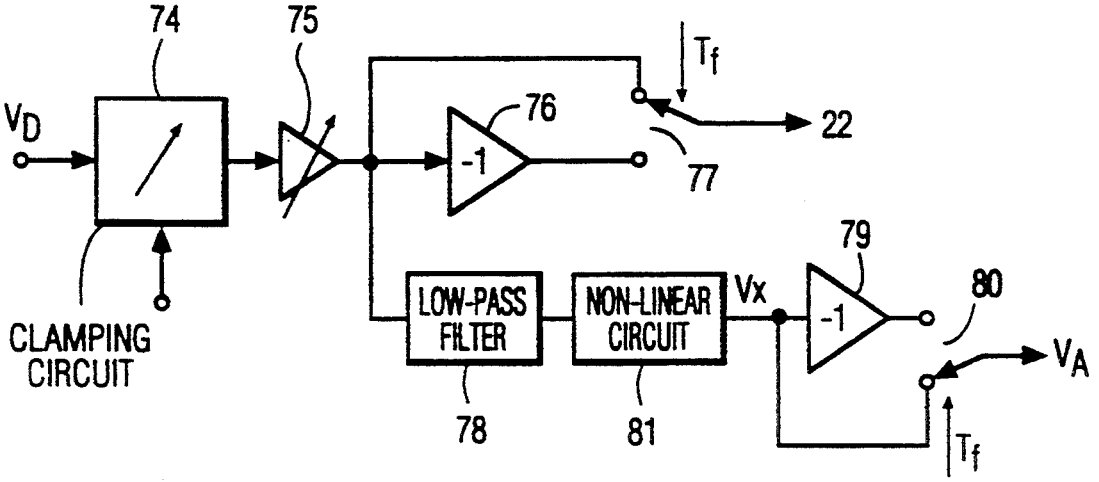

In an alternative arrangement, the $V_A$ output from the circuit of either FIG. 7(*a*) or 7(*b*) can be applied to the relevant column conductor 17 by means of a switch connected between the appropriate output of the column driver circuit 22 and that column conductor.

In the embodiments described so far, a single reference element circuit, comprising one MIM and an associated capacitor, has been employed. However, a plurality of reference circuits can be used instead. Part of a particularly advantageous embodiment of the display device using a plurality of reference circuits is shown schematically in FIG. 11. In this embodiment, the reference element circuits comprise a row of pseudo-picture elements 94, each consisting of a MIM connected to an LC element, formed simultaneously with the picture elements 14 but outside the display area occupied by the array of picture elements 14. The row of reference circuits 94, are addressed via a supplementary row conductor 16' provided with scanning signal waveform from the row driver circuit 20 and are supplied with the voltage signal $V_A$ via respective column conductors 17 using the circuit of FIG. 9, it being appreciated that this circuit provides the voltage signal to all column conductors via the column driver circuit 22. A further conductor 96 extending parallel to the row conductors is provided to which each reference circuit 94 is connected and from which the voltage level $V_B$ is obtained. This arrangement can be achieved very simply since the lines 16' and 96, the MIMs 35 with the LC element capacitors 36 are all fabricated simultaneously with the array of picture element and set of row conductors. Moreover, it ensures that the reference circuits are as close as possible in their electrical behaviour to the picture elements. The $V_B$ output obtained is based on the behaviour of all the reference circuits and thus more accurately represents the behaviour of an average picture element MIM.

Figure 12A:
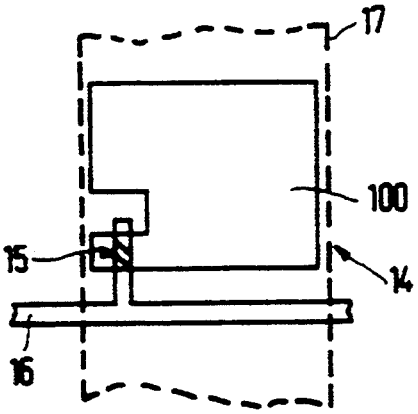
FIGS. 12(*a*) and 12(*b*) are schematic plan views of example picture and reference elements respectively used in an embodiment of the invention.
Figure 12B:
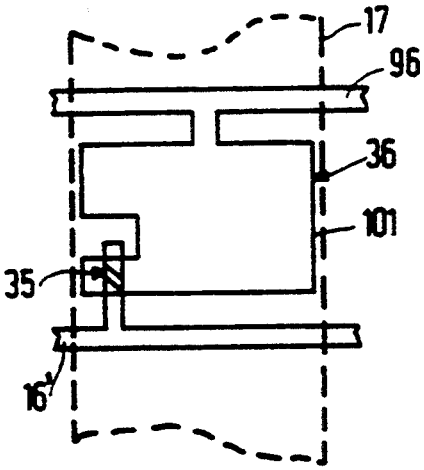

Although very similar structurally to a row of picture elements, the row of reference circuits includes the further conductor 96, and therefore it may be advantageous to adjust slightly the size of the LC elements of the reference circuits to compensate for any additional capacitance this conductor might introduce, bearing in mind that the conductor 96 and the column conductors 17 cross one another. FIGS. 12(*a*) and 12(*b*) show respectively in schematic plan view a typical picture element and a typical reference element for comparison, the pad electrode of the display element 14 being referenced 100 and the pad electrode of the LC element 36 being referenced at 101, and from which it is seen that the area of the pad electrode 101 is slightly less than that of the pad electrode 100. The size difference is chosen such that the capacitance of the LC element 36 together with that constituted by the section of the conductor 96 and the interconnecting bridge are approximately equal to the capacitance of the display element 14.

Figure 13:
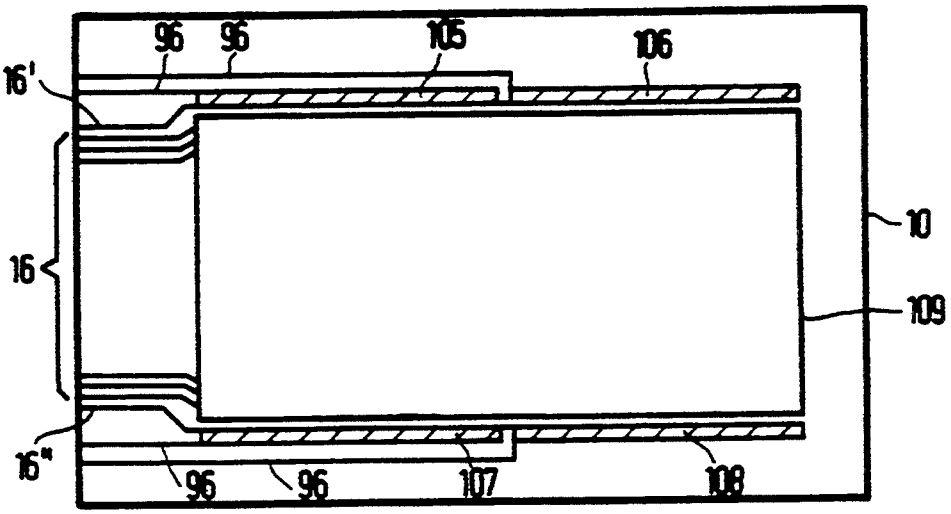
FIG. 13 is a schematic plan view of the display panel of a display device according to the invention comprising sets of reference circuits.

In a further, and advantageous, embodiment of display devices a plurality of separate sets of reference element circuits are included on the display panel 10. For example, two sets of reference element circuits may be provided adjacent the top of the display area of the panel and two further sets provided adjacent the bottom of the display area. Such an arrangement is illustrated schematically in FIG. 13, showing the display panel 10 of the display device, in which the four sets are depicted in shaded block form for simplicity and are referenced 105,106,107 and 108 respectively. The display area constituted by the array of picture elements 12 is referenced 109. The sets 105 and 106 comprise respective parts of a row of reference circuits (as in the embodiment of FIG. 11) to which a scanning signal waveform is applied via a common row conductor 16'. The $V_B$ connections to the sets 105 and 106 are provided by respective, separate, conductors 96. In like manner, the sets 107 and 108 comprise parts of one row of reference circuits addressed via a common supplementary row conductor 16'', and to which $V_B$ connections are provided by separate conductors 96. The use and disposition of several sets of reference circuits in this embodiment ensures that the average behaviour of the MIMs 35 of the reference circuits matches the average behaviour of the picture element MIMs 15 over the whole display area, which is particularly beneficial in large display devices. They serve also to provide a degree of redundancy in that the feedback compensation necessary to correct for the effects of HIM ageing can still be achieved even if only one of the four sets is functioning.

In all the above described embodiments, reference is made to the use of MIMs for the picture element and reference circuits. It should be understood, however, that other known forms of two terminal non-linear devices may be used instead.

Although the above embodiments comprise bidirectional non-linear devices, and MIMs in particular, it should be understood that the invention is applicable also to matrix display devices, and their method of operation, of the kind in which non-linear devices comprising unidirectional devices are used, for example as described in EP-A-0299546, whose disclosure is incorporated herein by reference, in which each display element is connected in series with a unidirectional diode element between respective row and column address conductors and also in series with a second unidirectional diode element to a respective reference voltage conductor which is common to the display elements in the same column, and in which a five level scanning signal waveform is applied to the row conductors. In this case the reference circuit(s) 34 comprise such a uni-directional device in series with a capacitor.

It is envisaged that passive electro-optical media other than liquid crystal material, such as electrochromatic materials or electrophoretic suspensions could be used instead.

From reading the present disclosure, other modifications will be apparent to persons skilled in the art. Such modifications may involve other features which are already known in the field of active matrix addressed display devices and which may be used instead of or in addition to features already described herein.

We claim:

1. A matrix display device comprising:

a. first and second sets of address conductors, said first set being arranged transversely of said second set;

b. an array of picture elements operable to produce a display, each of said picture elements including an electro-optic display element and a two-terminal nonlinear switching device electrically connected in series between a respective one of the first address conductors and a respective one of the second address conductors, each of said switching devices exhibiting a potentially changeable threshold characteristic;

c. a scanning signal drive circuit for sequentially applying selection signals to the first set of address conductors;

d. a data signal drive circuit for sequentially applying data signals to the second set of address conductors;

e. a reference circuit including a capacitor and a reference device electrically connected in series with each other, each of said capacitor and said reference device having respective first and second terminals, said first terminals being electrically connected to a common junction, said reference device comprising a nonlinear switching device exhibiting a potentially changeable threshold characteristic similar to that of the nonlinear switching device included in each of said picture elements;

f. means for applying to one of said second terminals a waveform representative of the selection signals applied to the first set of address conductors;

g. means for applying to the other one of said second terminals a voltage signal; and h. control means electrically connected to one of the drive circuits and to the common junction for adjusting the magnitude of the signals applied by said drive circuit to the respective address conductors in response to changes in the magnitude of a voltage sensed at the common junction.

2. A matrix display device as in claim 1 where the control means is electrically connected to the scanning signal drive circuit for adjusting the respective magnitudes of the selection signals in response to said changes in the magnitude of the voltage sensed at the common junction.

3. A matrix display device as in claim 2 where the control means includes a comparator for comparing a time-averaged value of the voltage sensed at the common junction with a reference value and means for adjusting the respective magnitudes of the selection signals in accordance with an output of the comparator.

4. A matrix display device as in claim 2 where:

a. the scanning signal drive circuit includes means for producing a scanning signal waveform including both said selection signals and reset signals; and b. the control means includes means for adjusting the respective magnitudes of the reset signals in response to said changes in the magnitude of the voltage sensed at the common junction.

5. A matrix display device as in claim 1 where the voltage signal has a predetermined magnitude.

6. A matrix display device as in claim 1 where the voltage signal is representative of the data signals applied to the second set of address conductors.

7. A matrix display device as in claim 1 where the reference device is carried on a first support and the nonlinear devices of the picture elements are carried on a second support.

8. A matrix display device as in claim 1 where the reference device, one of the first and second sets of address conductors, and the nonlinear devices of the picture elements are carried on a common support.

9. A matrix display device as in claim 8 where the common support includes an address conductor which is electrically connected to the reference device.

10. A matrix display device as in claim 9 where the set of address conductors carried on the support comprise the first set of address conductors.

11. A matrix display device as in claim 9 where the capacitor of the reference circuit is provided at least in part on said common support.

12. A matrix display device as in claim 11 where the capacitor of the reference circuit comprises an electro-optic element having a structure corresponding to that of the display elements.

13. A matrix display device as in claim 12 where the electro-optic element of the reference circuit is electrically connected to one of the address conductors of the second set.

14. A matrix display device as in claim 12 where the matrix display device includes a plurality of said reference circuits each electrically connected to a common one of the address conductors to which a respective one of the selection signals is applied by the scanning signal drive circuit.

15. A matrix display device as in claim 14 where the display device includes a plurality of sets of said reference circuits.

16. A matrix display device as in claim 15 where a first one of said sets of reference circuits is arranged adjacent to one side of an area occupied by the array of picture elements and where a second one of said sets of reference circuits is arranged adjacent to an opposing side of said area.

17. A matrix display device as in claim 1 where the electro-optic display elements comprise liquid crystal display elements.

18. A matrix display device as in claim 1 where the nonlinear switching devices comprise MIMs.

19. A method of operating a matrix display device comprising:

a. first and second sets of address conductors, said first set being arranged transversely of said second set;

b. an array of picture elements operable to produce a display, each of said picture elements including an electro-optic display element and a two-terminal nonlinear switching device electrically connected in series between a respective one of the first address conductors and a respective one of the second address conductors, each of said switching devices exhibiting a potentially changeable threshold characteristic;

c. a scanning signal drive circuit for sequentially applying selection signals to the first set of address conductors; and d. a data signal drive circuit for sequentially applying data signals to the second set of address conductors;

said method comprising the steps of utilizing a reference circuit including a capacitor and a reference device electrically connected in series with each other between first and second terminals, said reference device comprising a nonlinear switching device exhibiting a potentially changeable threshold characteristic similar to that of the nonlinear switching device included in each of said picture elements, by:

(1) applying to the first terminal a waveform representative of the selection signals applied to the first set of address conductors;

(2) applying to the second terminal a voltage signal; and (3) sensing changes in the magnitude of a voltage across the capacitor and adjusting the magnitude of the signals applied by one of the drive circuits to the respective address conductors in response to said changes.

20. A method as in claim 19 where the respective magnitudes of the selection signals are controlled in response to said changes in the magnitude of the voltage sensed across the capacitor.

21. A method as in claim 20 including the steps of determining a time-averaged value of the voltage sensed across the capacitor, comparing said value with a reference value, and adjusting the respective magnitudes of the selection signals in accordance with a difference between said values.

22. A method as in claim 19 where the magnitude of the voltage signal is representative of the data signals applied to the second set of address conductors.

23. A method as in claim 19 where the matrix display device includes a plurality of said reference circuits and where the signals applied by at least one of the drive circuits are controlled in accordance with predetermined variations in an average of the voltages across the capacitors of said reference circuits.

* * * * *